US005330379A

United States Patent [19]

Roh et al.

[11] Patent Number: 5,330,379

[45] Date of Patent: Jul. 19, 1994

[54] CONSTRUCTION SET

[76] Inventors: Douglas L. Roh; Katrina J. Roh, both of 718 Barham Down Dr., Manchester, Mo. 63011

[21] Appl. No.: 42,702

[22] Filed: Apr. 5, 1993

[51] Int. Cl.[5] ..... A63H 33/00; A63H 33/04; A63H 33/30; A47C 7/00

[52] U.S. Cl. ..... 446/71; 446/85; 446/478; 446/901; 297/DIG. 6; 297/440.14

[58] Field of Search ..... 297/DIG. 6, 440.14, 297/440.1, 440.23, 440.2; 446/71, 76, 77, 85, 108, 109, 110, 112, 111, 114, 115, 476, 478, 482, 486, 487, 901

[56] References Cited

U.S. PATENT DOCUMENTS

| | | | |
|---|---|---|---|
| 992,337 | 5/1911 | Butler | 446/110 X |
| 1,379,648 | 5/1921 | Niebel . | |
| 1,620,574 | 3/1927 | Savage . | |
| 1,629,199 | 5/1927 | Bosslet | 446/110 X |
| 2,620,018 | 12/1952 | Pagano . | |
| 3,236,003 | 2/1966 | Flood, Jr. | 446/110 |
| 3,563,599 | 2/1971 | Heumann | 297/DIG. 6 X |
| 3,929,375 | 12/1975 | Gans . | |
| 4,212,130 | 7/1980 | Walker | 446/111 |
| 4,343,117 | 8/1982 | Shemitz . | |
| 4,561,137 | 12/1985 | Smitherman et al. | 297/DIG. 6 X |
| 4,884,988 | 12/1989 | McMurray | 446/901 X |
| 4,932,721 | 6/1990 | Anthony | 297/440.1 X |
| 4,946,414 | 8/1990 | Zimmer | 446/71 |
| 4,978,301 | 12/1990 | Dodge | 446/108 X |
| 4,979,924 | 12/1990 | Manger . | |
| 5,085,608 | 2/1992 | Turner | 446/482 X |

FOREIGN PATENT DOCUMENTS

| | | | |
|---|---|---|---|
| 0356626 | 3/1990 | European Pat. Off. | 446/901 |
| 3704105 | 11/1988 | Fed. Rep. of Germany | 446/122 |

*Primary Examiner*—Danton D. DeMille
*Assistant Examiner*—D. Neal Muir
*Attorney, Agent, or Firm*—Grace J. Fishel

[57] ABSTRACT

A toy that can be stored as a sofa having a bench, a backrest and a headrest and that can be taken apart to build structures large enough for a child to crawl through or play in. The toy is a construction set with a plurality of first, second and third pieces. The first pieces form the bench, the second pieces form the backrest and the third pieces form the headrest. The pieces are solids with planar faces and are rearrangable into a play house having sidewalls, gables and a roof wherein the first pieces form the sidewalls, the second pieces form the roof and the third pieces for-the gables. Pairs of fasteners of opposite gender are arranged on the faces of the first, second and third pieces for joining the pieces into the sofa, the play house and other structures. Even numbers of pairs of fasteners of opposite polarity are provided for joining the pieces in more than one orientation.

7 Claims, 3 Drawing Sheets

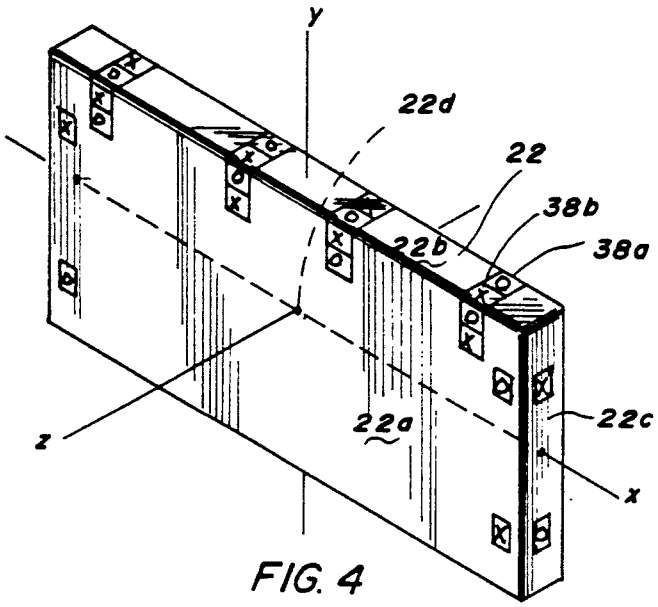
FIG. 4
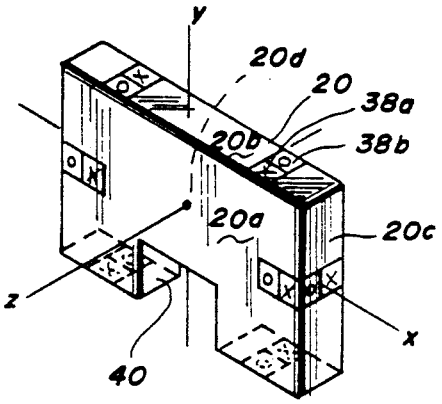
FIG. 3
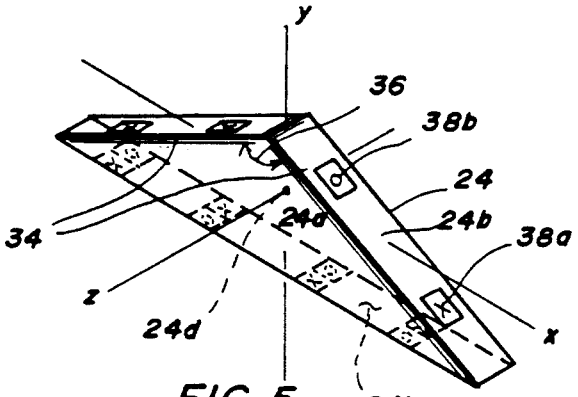
FIG. 5
FIG. 6
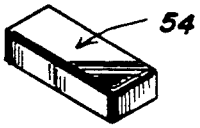
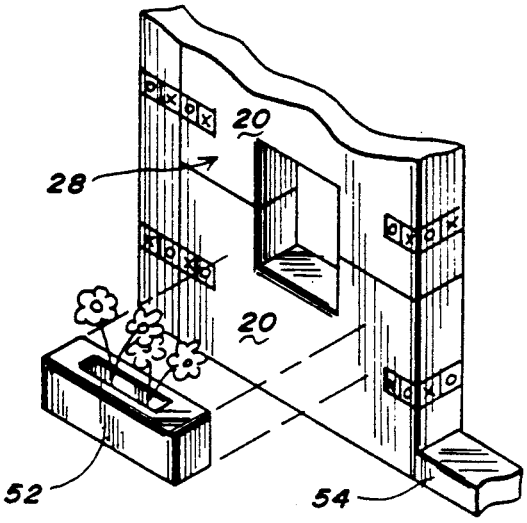
FIG. 7

CONSTRUCTION SET

The present invention relates to a construction set that can be stored in the form of a sofa and that can be used to make structures large enough for a child to crawl through or play in.

BACKGROUND OF THE INVENTION

Children like to play with sofa cushions because they can be rearranged to suit the child and can be used to build large structures. In many homes, children are not allowed to play with the sofa cushions. There are child-size hard plastic prefabricated houses and gyms for children aged about three through nine. These toys are put together by adults, they are space consuming and they have limited play value because a child cannot rearrange the pieces.

A class of toy which seems to be missing is a construction set which can be stored in the form of a sofa and which can be taken apart for use by children to build structures which they can crawl through or be in. Such a toy would allow a child to explore his imagination and would not be space consuming since it could be stored as a functional sofa. It would also be educational.

OBJECTS AND SUMMARY OF THE INVENTION

It is an important object of the present invention to provide a toy which can be stored as a piece of functional furniture and which can be rearranged into a number of structures. Other objects and features will be in part apparent and in part pointed out hereinafter.

In accordance with the invention, a construction set is provided that can be stored in a form of a sofa having a bench, a backrest and a headrest. The construction set includes a plurality of first pieces forming the bench, a plurality of second pieces forming the backrest and a plurality of third pieces forming the headrest. The pieces are solids with planar faces and are rearrangable into a number of different forms including a house having sidewalls, gables and a roof. The first pieces form the sidewalls, the second pieces form the roof and the third pieces form the gables.

In one embodiment, pairs of fasteners of opposite gender are arranged on the faces of the first, second and third pieces. Even numbers of pairs of fasteners of opposite polarity are positioned about the faces such that when like faces with fasteners of like pieces are placed in registry, some of the fasteners on the contacting faces mate (e.g., the first pieces mate along corresponding faces that have fasteners of opposite gender, the second pieces mate along corresponding faces, etc.). The pairs of fasteners are further positioned about the faces such that some of the fasteners on at least one face of each piece mate with some of the fasteners on at least one face of each unlike piece (e.g., the first pieces also mate with the second and third pieces in some orientation, the second pieces mate with the first and third pieces, etc.).

The invention as summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which:

FIG. 3 is a perspective view of a first piece used in constructing the bench and the sidewalls;

FIG. 4 is a perspective view a second piece used in constructing the backrest and the roof;

FIG. 5 is a perspective view a third piece used in constructing the headrest and the gables;

FIG. 6 is a perspective view a fourth piece used in constructing the armrest and a doorsill;

FIG. 7 is a perspective view illustrating one of many optional attachments; and, FIG. 8 is a perspective view of part of the construction set (i.e., the third pieces are not used) assembled into other fanciful structures.

DETAILED DESCRIPTION OF THE INVENTION

Figure 1:
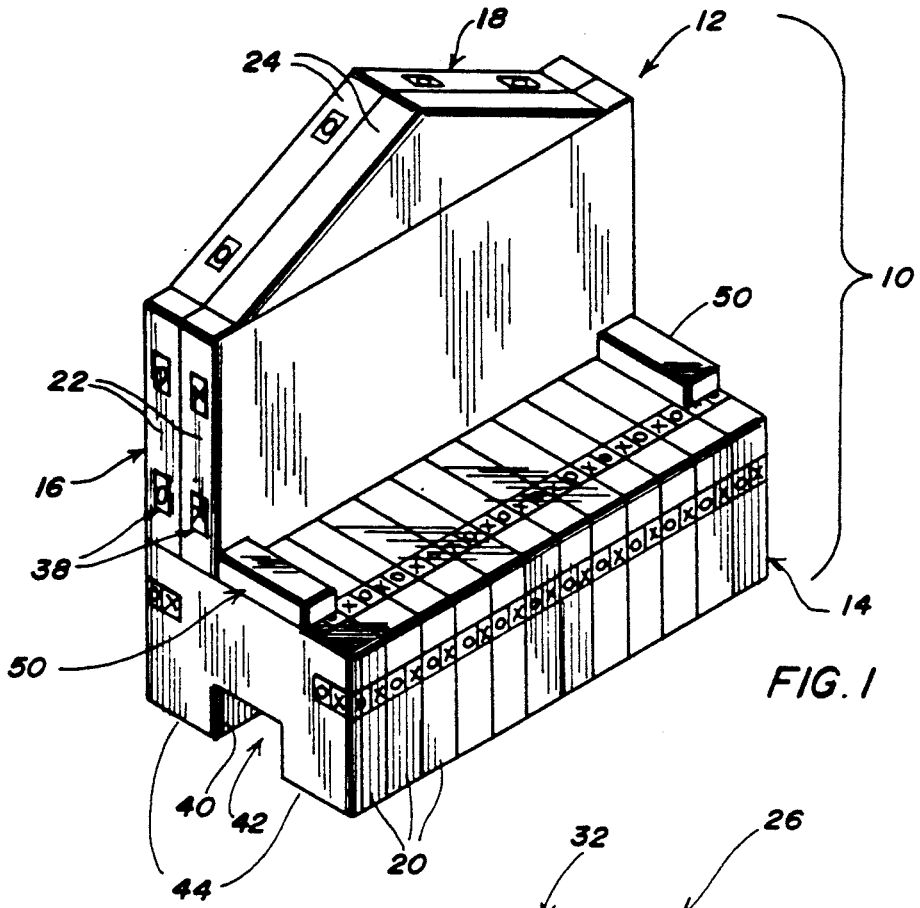
FIG. 1 is a perspective view of a construction set in accordance with the present invention stored as a sofa having a bench, a backrest and a headrest along with an optional armrest.

Referring to the drawings more particularly by reference number, reference numeral 10 refers to a construction set in accordance with the present invention. As shown in FIG. 1, construction set 10 can be stored in a form of a sofa 12 having a bench 14, a backrest 16 and a headrest 18. A plurality of first pieces 20 (illustrated as twelve) form bench 14, a plurality of second pieces 22 (illustrated as two) form backrest 16 and a plurality of third pieces 24 (illustrated as two) form headrest 18.

Figure 2:
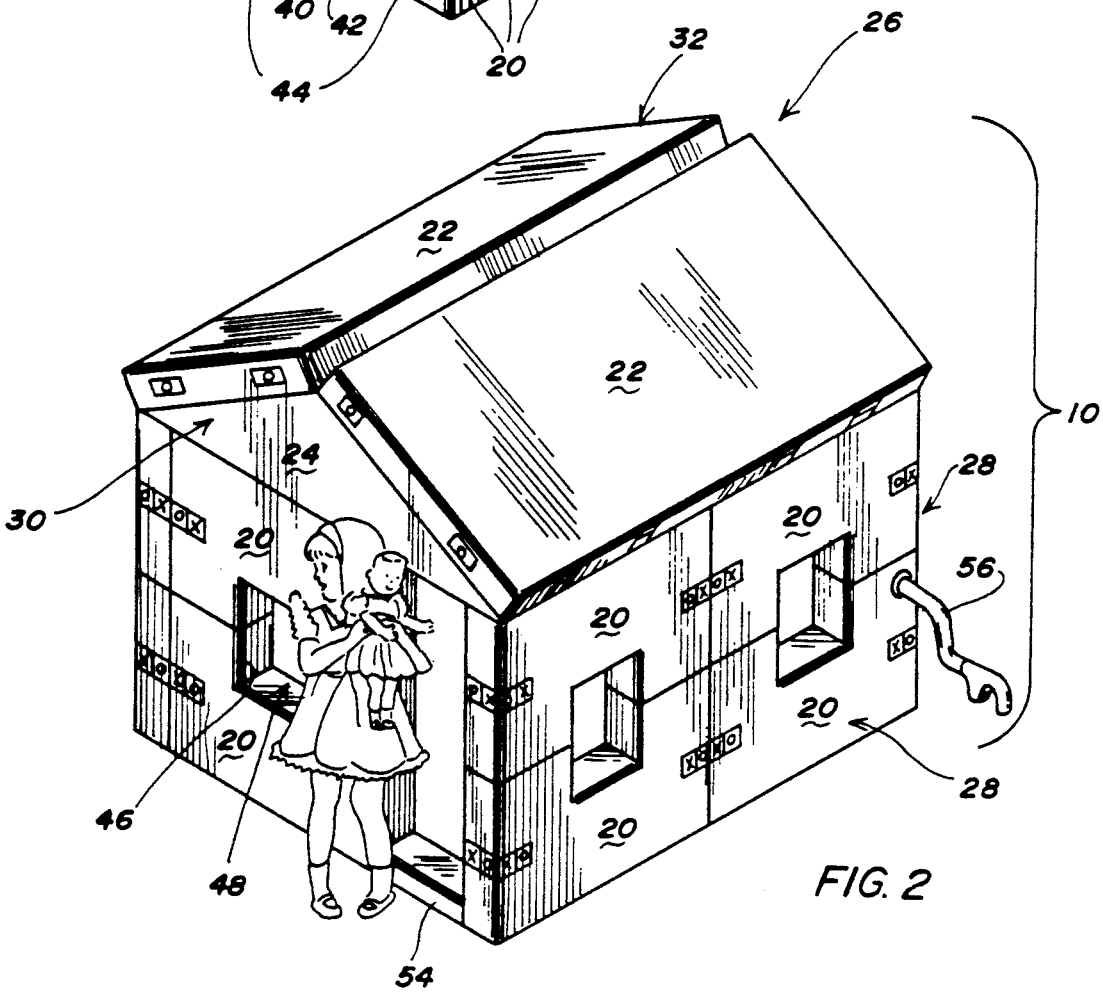
FIG. 2 is a perspective view of the construction set assembled into a play house having sidewalls, gables and a roof.

Sofa 12 can be taken apart and pieces 20, 22 and 24 used to build a number of different structures including a house 26 as shown in FIG. 2. House 26 includes sidewalls 28, gables 30 and a roof 32. First pieces 20 form sidewalls 28, second pieces 22 form roof 32 and third pieces 24 form gables 30.

Figure 8:
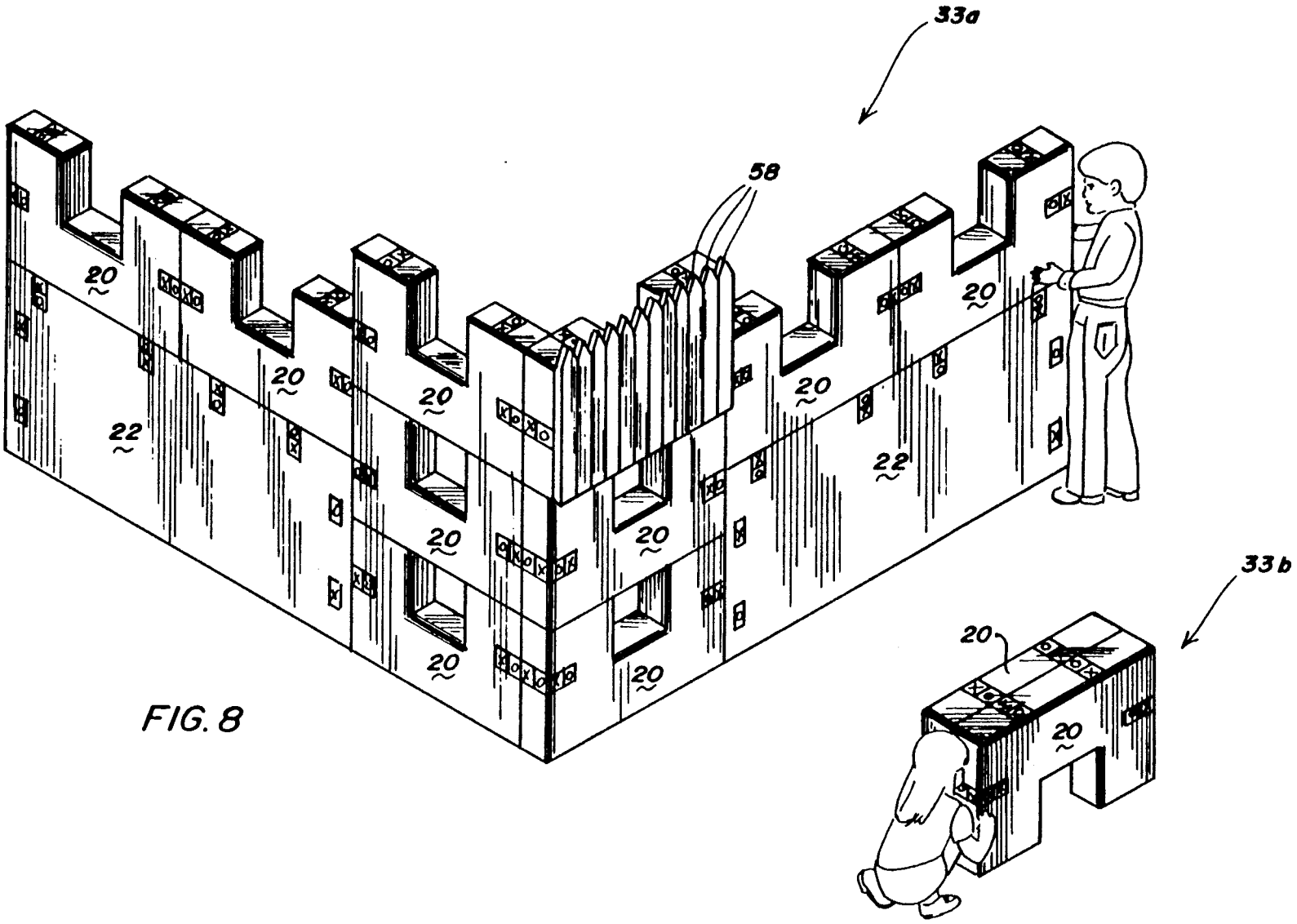

As illustrated, pieces 20 stack two units high and two units long to form a pair of opposing sidewalls without a door and stack two units high and one unit long to form a pair of opposing sidewalls with a door. Pieces 22 and 24 form gables 30 and roof 32 over the area enclosed by sidewalls 28. In addition to sofa 12 and house 26, construction set 10 can be used to make a castle or fort 33*a* and bridge 33*b* as shown in FIG. 8 (in this view third pieces 24 are not used) or a host of other structures as will readily occur to children if left uninhibited by adults. For example, second pieces 22 can be bent into cylinders and used as a tunnel or a tower and so forth.

Pieces 20, 22 and 24 are solids with planar faces as more particularly described below and may have filled or hollow cores. Pieces 20, 22 and 24 may be made of a number of different lightweight materials such as foamed rubber or plastic, jelly molded plastic, inflatable plastic cushions, cardboard boxes and the like. In selecting a material for pieces 20, 22 and 24, one important criteria is that the pieces not be too rigid or heavy to cause injuries if the pieces are thrown or stepped on or such that young children will have difficulty using them.

As best seen in FIGS. 3 and 4, first and second pieces 20, 22 are right rectangular solids with six faces arranged in pairs of parallel faces (20*a*,20*a*), (20*b*,20*b*), (20*c*,20*c*), and (22*a*,22*a*), (22*b*,22*b*), (22*c*,22*c*), respectively. Each piece has a center (20*d* and 22*d*, respectively) equidistant between each pair of parallel faces. First and second pieces 20, 22 have a set of three mutually orthogonal axes (x, y and z in the drawings) that are parallel to the faces and having an origin passing through center 20*d*, 22*d*, respectively. As best seen in FIG. 5, third pieces 24 are solids with two parallel triangular faces (24*a*,24*a*) and three right rectangular faces (24*b*,24*b*,24*b*). Each triangular face 24*a* has at least two equal sides 34 with an interior angle 36 between the two equal sides of 60 degrees or greater (i.e., the triangular faces are isosceles or equilateral). Third pieces 24 have a set of three mutually orthogonal axes (x, y and z in the drawings). One of the axes (illustrated as x) is parallel to triangular faces (24*a*,24*a*), a second (illustrated as z) is normal to the triangular faces and a third (illustrated as y) is aligned with a line bisecting interior angle 36 between equal sides 34 with the origin of the axes centered at 24*d* between the triangular faces. The height of triangular faces (24*a*,24*a*) is small as compared to its base so that when piece 24 is serving as a gable, the pitch of roof 32 is low and pieces 24 do not slide off.

Pairs of fasteners 38*a*, 38*b* of opposite gender are arranged on the planar faces of said first, second and third pieces 20, 22 and 24, respectively. Pairs of fasteners 38*a*, 38*b* have a polarity in the sense that like pairs with the same orientation will not stick together but that pairs of opposite orientation will stick together. Even numbers of pairs of fasteners of opposite polarity are located on opposite sides of centers 20*d*, 22*d* and 24*d* so that when like faces (of like pieces) having fasteners of opposite gender are placed in registry, some of the fasteners on the contacting faces mate. Fasteners 38*a*, 38*b* are also positioned about the faces such that some of the fasteners on at least one face of each first, second and third piece 20, 22, 24, respectively, mate with some of the fasteners on at least one face of each unlike piece.

Fasteners 38*a*, 38*b* of opposite gender may be snaps, hooks and so forth. Fasteners 38*a*, 38*b* are preferably provided in the form of hook and pile fasteners such as are sold under the trademark Velcro and are attached in pairs to pieces 20, 22 and 24 by gluing or sewing. Pieces 20, 22 and 24 may include a fabric cover to which fasteners 38, 38*b* are attached.

A cutout 40 in first pieces 20 is centered along one edge and connects parallel faces (20*a*,20*a*). Cutout 40 is of uniform cross section throughout the piece. Cutout 40 forms a channel 42 defining legs 44 when faces (20*a*,20*a*) of pieces 20 are placed in registry as shown in FIG. 1 to form bench 14. Cutout 40 forms a framed opening 46 defining a window 48 as shown in FIG. 2 when pieces 20 are placed in registry along that face 20*b* with the cutout. For first pieces 20 to be useful in making legs 44 and windows 48, pieces 20 have a two-fold axis of rotation about the x and y axis.

Faces (22*b*,22*b*) of second pieces 22 have a two-fold axis of rotation. This permits second pieces 22 to mate with first and third pieces 20 and 24 in at least two different orientations, for example, to form backrest 16. Face 24*b* of third pieces 24 opposite angle 36 also has a two-fold axis of rotation. This permits third pieces 24 to mate with first and second pieces 20 and 22 in at least two different orientations to form gables 30 or headrest 18, respectively.

Auxiliary pieces such as armrests 50 or a flower box 52 may be provided. These pieces may be loose (e.g., armrests 50) or attached with fasteners such as Velcro or the like (e.g., flower box 52). As shown in FIG. 2, armrests 50 form a doorsill 54 in house 26 and keep sidewalls 28 vertical. Other decorations such as a gas hose and nozzle 56 (shown in FIG. 2), pickets 58 (shown in FIG. 8 which are useful in converting the castle into a fort), strips with letters or numbers, and so forth may also be attached with suitable fasteners.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A construction set that can be stored in a form of a sofa having a bench, a backrest and a headrest comprising a plurality of first pieces forming the bench, a plurality of second pieces forming the backrest and a plurality of third pieces forming the headrest, wherein pairs of fasteners of opposite gender are arranged on the faces of said first, second and third pieces, with even numbers of pairs of fasteners of opposite gender positioned about the faces such that when like faces with fasteners of like pieces are placed in registry, some of the fasteners on the contacting faces mate, said pairs of fasteners further positioned about the faces such that some of the fasteners on at least one face of each first, second and third pieces mate with some of the fasteners on at least one face of each unlike piece, said pieces being flexible solids with planar faces and being easily and completely disassembled from the sofa form and rearranged into a toy house having sidewalls, gables and a roof wherein the first pieces form the sidewalls, the second pieces form the roof and the third pieces form the gables.

2. The construction set of claim 1 wherein each of said first and second pieces is a right rectangular solid with six faces arranged in pairs of parallel faces and has a center equidistant between each pair of parallel faces, each of said first and second pieces having three mutually orthogonal axes, said axis being parallel to the faces and having an origin passing through the center and each of said third pieces being a solid having two parallel triangular faces and three right rectangular faces, each triangular face having at least two equal sides with an interior angle between the two equal sides of 60 degrees or greater, each of said third pieces having a set of three mutually orthogonal axes, a first of said axes being parallel to the triangular faces, a second being normal to the triangular faces and a third being aligned with a line bisecting the interior angle between the equal sides with the origin of the axes centered between the triangular faces.

3. The construction set of claim 2 wherein the first pieces have a cutout centered along corresponding edges of each first piece and the pairs of fasteners are arranged on each of said first pieces in such manner that each said piece has a two-fold axis of rotation about at least two of the axes for mating whereby the cutouts form a channel when the first pieces are arranged as the bench of a sofa and a framed opening when arranged as the sidewall of a house.

4. The construction set of claim 3 wherein some of the pairs of fasteners on at least one face of each second piece are arranged in such manner that the piece has a two-fold axis of rotation about at least one axis for mating whereby the second pieces mate with the first and third pieces in at least two different orientations.

5. The construction set of claim 4 wherein some of the pairs of fasteners on at least one face of each third piece are arranged in such manner that the piece has a two-fold axis of rotation about at least one axis for mating whereby the third pieces mate with the first and second pieces in at least two different orientations.

6. A construction set that can be stored in a form of a sofa having a bench, a backrest and a headrest comprising a plurality of first pieces forming the bench, a plurality of second pieces forming the backrest and a plurality of third pieces forming the headrest, said pieces being flexible solids with planar faces and being easily and completely disassembled from the sofa form and rearranged into a toy house having sidewalls, gables and a roof wherein the first pieces form the sidewalls, the second pieces form the roof and the third pieces form the gables, pairs of hook and pile fasteners are arranged on the faces of said first, second and third pieces, even numbers of pairs of fasteners of opposite gender are positioned about the faces such that when like faces with fasteners of like pieces are placed in registry, some of the fasteners on the contacting faces mate, said pairs of fasteners further positioned about the faces such that some of the fasteners on at least one face of each first, second and third pieces mate with some of the fasteners on at least one face of each contacting unlike piece.

7. The construction set of claim 6 wherein each of said first and second pieces is a right rectangular solid with six faces arranged in pairs of parallel faces and has a center equidistant between each pair of parallel faces, each of said first and second pieces having three mutually orthogonal axes, said axis being parallel to the faces and having an origin passing through the center and each of said third pieces being a solid having two parallel triangular faces and three right rectangular faces, each triangular face having at least two equal sides with an interior angle between the two equal sides of 60 degrees or greater, each of said third pieces having a set of three mutually orthogonal axes, a first of said axes being parallel to the triangular faces, a second being normal to the triangular faces and a third being aligned with a line bisecting the interior angle between the equal sides with the origin of the axes centered between the triangular faces, said first pieces having a cutout centered along corresponding edges of each first piece and the pairs of fasteners are arranged on each of said first pieces in such manner that each said piece has a two-fold axis of rotation about at least two of the axes for mating whereby the cutouts form a channel when the first pieces are arranged as the bench of a sofa and a framed opening when arranged as the sidewall of a house.

* * * * *